US012644449B2

(12) United States Patent
Neff et al.

(10) Patent No.: US 12,644,449 B2
(45) Date of Patent: Jun. 2, 2026

(54) PUMP MONITORING SYSTEM AND METHOD

(71) Applicant: Viking Pump, Inc., Cedar Falls, IA (US)

(72) Inventors: Cameron Neff, Waterloo, IA (US); Michael Strei, Cedar Falls, IA (US); John Hall, Cedar Falls, IA (US); Ahmad Shehata, Cedar Falls, IA (US); Randy Antonich, Frederic, WI (US); Scott Meyer, Brandon, IA (US); Nick Thompson, Cedar Falls, IA (US)

(73) Assignee: Viking Pump, Inc., Cedar Falls, IA (US)

( * ) Notice: Subject to any disclaimer, the term of this patent is extended or adjusted under 35 U.S.C. 154(b) by 120 days.

(21) Appl. No.: 18/338,903

(22) Filed: Jun. 21, 2023

(65) Prior Publication Data

US 2023/0407863 A1 Dec. 21, 2023

Related U.S. Application Data

(60) Provisional application No. 63/353,952, filed on Jun. 21, 2022.

(51) Int. Cl.
*F04B 51/00* (2006.01)
*F04D 27/00* (2006.01)

(52) U.S. Cl.
CPC ..... *F04B 51/00* (2013.01); *F04D 27/001* (2013.01); *F04B 2201/0802* (2013.01)

(58) Field of Classification Search
CPC . F04B 51/00; F04B 2201/0802; F04D 27/001
See application file for complete search history.

(56) References Cited

U.S. PATENT DOCUMENTS 4,813,858 A * 3/1989 Eisenbacher ..... F04C 2/103 418/61.3
5,566,092 A * 10/1996 Wang ..... G05B 19/4184 706/912

(Continued)

FOREIGN PATENT DOCUMENTS

JP 2021092182 A 6/2021

OTHER PUBLICATIONS

"Detect Sensor," Redraven Data Sheet, Flowserve, 2 pages, Jul. 2020.

(Continued)

*Primary Examiner* — Christopher S Bobish
(74) *Attorney, Agent, or Firm* — Tucker Ellis LLP; Michael G. Craig

(57) ABSTRACT

Provided herein is a system and method for monitoring, troubleshooting, and providing predictive maintenance to pumps systems. The methods provided herein can utilize and/or interpret physical phenomena of pump systems and components thereof. The physical phenomena may include, but is not limited to, vibration, temperature, sound, or similar characteristics. Further, a cloud-based system can collect data from autonomously operated systems, to provide visualizations of collected data via a user interface, and analyze the collected data with various models to predict maintenance, determine optimizations, and facilitate troubleshooting of the systems.

20 Claims, 11 Drawing Sheets

(56) References Cited

U.S. PATENT DOCUMENTS 5,602,757 A * 2/1997 Haseley ..... F04C 28/28 702/56
6,260,004 B1 * 7/2001 Hays ..... F04D 15/0088 702/183
6,330,525 B1 * 12/2001 Hays ..... F04D 15/0088 702/182
6,721,683 B2 * 4/2004 Harris ..... G05B 23/0227 702/100
6,757,665 B1 * 6/2004 Unsworth ..... G06N 3/088 706/5
7,097,351 B2 * 8/2006 Lancon ..... G01N 3/60 374/57
7,539,549 B1 * 5/2009 Discenzo ..... F04D 15/0077 702/183
8,290,630 B2 * 10/2012 Lakomiak ..... G05B 23/0221 702/56
8,401,806 B2 * 3/2013 Borsting ..... F04D 15/0088 702/56
9,330,560 B2 5/2016 Lawson
10,330,567 B2 * 6/2019 Ochsenfeld ..... G01M 7/00
10,458,416 B2 * 10/2019 Mangutov ..... F04D 15/0088
10,711,802 B2 * 7/2020 Hambe ..... F04D 29/445
10,983,087 B2 4/2021 Chen et al.
11,566,625 B2 * 1/2023 Juul Nielsen ..... F04D 13/06
11,828,160 B2 * 11/2023 Al Shehri ..... F04D 13/10
2003/0171895 A1 * 9/2003 Harris ..... G05B 23/0227 702/183
2012/0204627 A1 * 8/2012 Anderl ..... F04B 1/26 73/64.53
2015/0122037 A1 * 5/2015 Obaia ..... F04D 7/04 73/660
2016/0208794 A1 * 7/2016 Singh ..... F04B 51/00
2017/0082101 A1 * 3/2017 Urdaneta ..... F04B 1/00
2019/0203736 A1 * 7/2019 Hambe ..... F04D 29/66
2021/0115928 A1 * 4/2021 Nielsen ..... F04D 13/06
2022/0381134 A1 * 12/2022 Al Shehri ..... E21B 43/126
2024/0184282 A1 * 6/2024 Dev ..... G06N 20/20
2024/0200552 A1 * 6/2024 Budampati ..... G01M 7/00

OTHER PUBLICATIONS

The Written Opinion of the International Searching Authority and International Search Report from the related PCT Application PCT/US2023/068809 dated mailed Oct. 4, 2023, 9 pages.

* cited by examiner

PUMP MONITORING SYSTEM AND METHOD

CROSS-REFERENCE TO RELATED APPLICATIONS

This application claims priority to U.S. Provisional Patent Application Ser. No. 63/353,952, entitled PUMP MONITORING SYSTEM AND METHOD, filed Jun. 21, 2022, which is incorporated herein by reference.

BACKGROUND

Pumps can be used to transport product such as liquid or gas from one location to another. As a basic principle, pumps transfer a product by converting mechanical energy of a motor to fluid flow energy. This process can also generate friction, vibration, resulting in sound and heat, for example. In some circumstances, excess sound, heat, or vibration can be indicative of certain wear and tear or damage to the pump system.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

Provided herein is a system and method for monitoring, troubleshooting, and providing predictive maintenance and life-cycle information for pumps systems. The methods provided herein may utilize and/or interpret physical phenomena of pump systems and components thereof. The physical phenomena may include, but is not limited to, vibration, temperature, sound, or similar characteristics, which can be converted to predictive wear, damage, pump efficiency, and other useful data.

In an exemplary embodiment, a method of monitoring pump systems can comprise monitoring at least one characteristic of a pump system with a least one sensor, wherein the at least one sensor is located proximate a component of the pump system, receiving, from the at least one sensor at a controller, at least one sensor value associated with the at least one characteristics of the pump system, the at least one sensor value further received by a remote network, wherein the at least one sensor value is accessible from a user device in communication with the remote network, determining, with the controller, a fault condition of the pump system, the fault condition triggered when the at least one sensor value falls outside of a pre-determined threshold value, the threshold values are configured to correlate with the at least one corresponding fault condition of the pump system, and transmitting a fault detection notification when the fault condition is triggered, the fault detection notification sent to an end user of the pump system.

According to an embodiment, the at least one sensor value is analyzed by at least one algorithm, the at least one algorithm configured to determine a status condition of the pump system.

According to an embodiment, the status condition of the pump system relates to the health status of the pump system, the health status indicating whether the pump needs maintenance or if the pump is healthy.

According to an embodiment, the fault detection notification is sent via email or SMS messaging, or may utilize other known digital communication protocols, such as wireless communications, over cloud-based messaging, Ethernet or similar communication (e.g., directly with plant DCS systems).

According to an embodiment, the at least one sensor is a vibration sensor and the at least one characteristic is a vibration of the pump system.

In other non-limiting embodiments, a cloud-based system collects data from components, including at least a pump, from one or more mechanical and/or electro-mechanical systems such as lease automatic custody transfer (LACT) units. The data may be transmitted by a controller of the system or collected by a collection & communication (C&C) device coupled to system to acquire data and send the data to the cloud-based system. The cloud-based system provides a user interface to visualize collected data. The cloud-based system further analyzes collected data with various predictive models to anticipate failures, provide optimizations, etc.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

DETAILED DESCRIPTION

Figure 1:
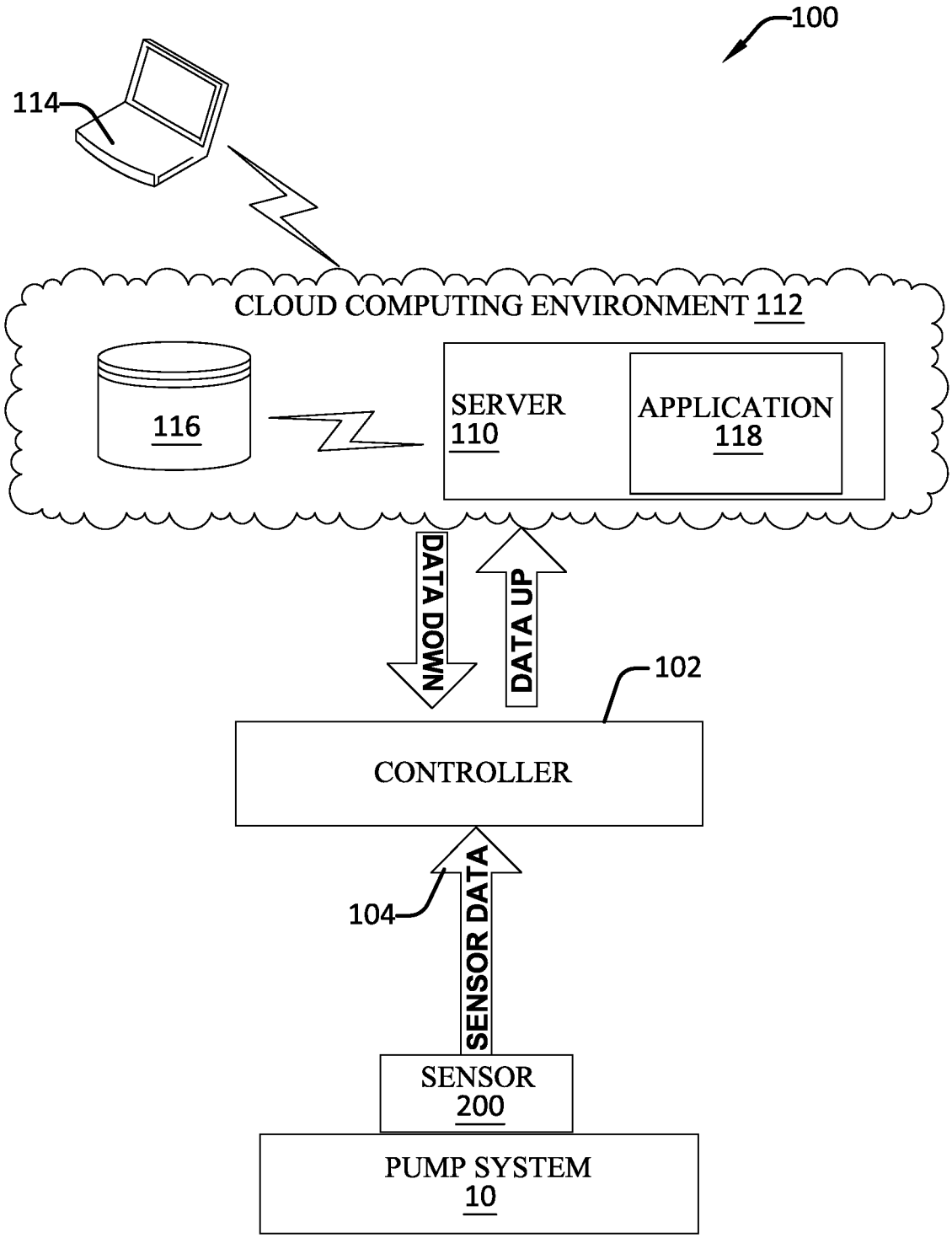
FIG. 1 is a system diagram illustrating an exemplary pump monitoring system.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

In one aspect, a pump monitoring system may monitor at least one characteristic of a pump system, which can include tankage, piping, valving, motor, gearbox, and other appurtenances upstream and downstream of the pump, for example. The characteristic may be one or more of the following: temperature, vibration, sound, light, or any other suitable characteristic that can be generated by operation of the pump system. The pump monitoring system may collect data corresponding to at least one characteristic of the pump system. The data may be in the form of raw or processed data and may be used to detect a condition of the pump system.

The data may be transmitted to a server and/or a remote (e.g., cloud) network where the data may be analyzed. Alternatively, the data may be analyzed locally at the pump system or may be analyzed using any combination of local or cloud computer environments. The system may be configured to compare the data to corresponding thresholds or may analyze the data using at least one algorithm to determine a condition of the pump system. By way of example, the condition may be one or more of the following: healthy, system fault, system error, needs maintenance, needs attention, system warning, maintenance required soon, and any other applicable pump status or condition. Additionally or alternatively, the condition of the pump system may be related to pump statistics, tuning recommendations, pump optimization suggestions, real time data visualization, real time data analysis, and the like.

The system may be configured to alert a user of a determined pump condition. The pump condition may be communicated to a user by way of human machine interface (HMI), user device, SMS text message, email notification, alarm, sound, or any other suitable notification means. By way of example, a pump motor fault may be communicated to a technician via SMS text message.

Pump monitoring systems currently on the market may work only with equipment running at high speeds and with machine conditions at high frequencies. Until the disclosure of this application, systems and methods for monitoring low frequency pump systems have been inadequate and inaccurate. The exemplary pump monitoring system disclosed herein may perform accurately for pump systems that operate at lower frequencies (e.g., positive displacement pumps, etc.).

FIG. 1 depicts an exemplary pump monitoring system 100. The pump monitoring system 100 can include a controller 102 configured to communicate with a sensor 200. The controller 102, which can also be referred to as a gateway, can receive data from various sensors via a wired or wireless communication link. For example, the controller 102 can receive a sensor signal 104 from the sensor 200. The sensor signal 104 can include information pertaining to a characteristic of a pump system 10. The pump system 10 may include a single pump or a plurality of pump and pump components. For ease of discussion, all components will be referred to generally as the pump system 10. The controller 102 can be located locally to the various sensors 200, or may be located remotely. The controller 102 can receive the sensor signal 104, store the corresponding sensor data, and/or perform various processing or calculations with the data.

In certain embodiments, the controller 102 can also communicate the sensor information in a raw or a processed form to a server 110. It should be appreciated that the server 110 can be local, remote, or remote-based as part of a cloud computing environment 112. In various embodiments, the controller 102 can exist as part of the server 110. The server 110 can also be distributed among multiple locations and/or devices. It is to be appreciated that the server 110 can be at least one of a website, a server device, a computer, a cloud-service, a processor and memory, or a computing device connected to the Internet and connected to a user device 114. In general, a network can be implemented to couple one or more devices of system 100 via wired or wireless connectivity, over which data communications are enabled between devices and between the network and at least one of a second network, a subnetwork of the network, or a combination thereof. It is to be appreciated that any suitable number of networks can be used with the subject innovation and data communication on networks can be selected by one of sound engineering judgment and/or one skilled in the art.

In certain embodiments, the cloud computing environment 112 can also include a database 116. The database 116 can receive information from the server 110 regarding sensor information, sensor data, alerts, notifications, historic sensor data, user information, among other information. The database 116 may be a standalone storage component or it may exist as part of the server 110.

A user device 114 may communicate with the cloud computing environment 112 to send and receive information to and from the server 110 and/or the database 116. The user device 114 may be, for example, a computer, or a mobile device such as a smartphone or tablet, a wearable device, among others. The user device 114 may interact with an application 118 operating on the server 110. When executed, the application 118 can interact with the user device 114 to allow a user to view sensor information, view corresponding notifications or alerts, manipulate sensor information, analyze sensor information, or update settings for the server 110, application 118, controller 102, or sensor 200. The user device 114 can provide a user interface that allows for user interactions with the application 118. It should be appreciated that in certain embodiments, the application 118 may also exist locally on the user device 114 and receive information from the server 110.

One of ordinary skill in the art can appreciate that the various embodiments of the application 118 described herein can be implemented in connection with any computing device, client device, or server device, which can be deployed as part of a computer network or in a distributed computing environment such as the cloud. The various embodiments described herein can be implemented in substantially any computer system or computing environment having any number of memory or storage units, any number of processing units, and any number of applications and processes occurring across any number of storage units and processing units.

It should be appreciated that the pump monitoring system 100 can include a sensor array 200, which may include one or a plurality of sensors 200. The sensor array 200 may include a temperature sensor, a vibration sensor, an audio sensor, a GPS location sensor, an orientation sensor, a gyro sensor, an accelerometer, frequency sensor, and/or any other suitable sensor. The sensor array 200 may also include one or more sensing capabilities. For instance, the sensor array 200 may be capable of monitoring both temperature and vibration. It should be appreciated that the one or more sensors in the sensor array 200 can be configured according to sound engineering judgment and system specific requirements.

Figure 2:
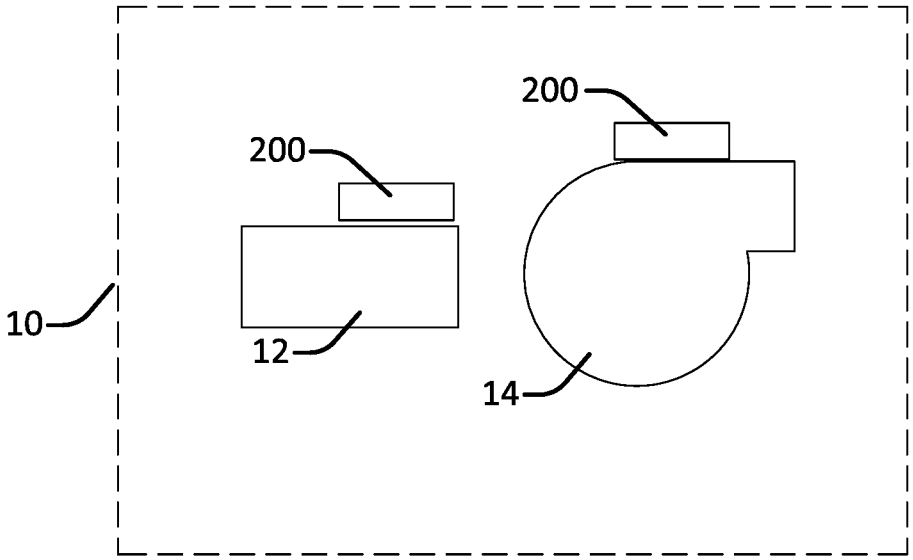
FIG. 2 is a system diagram illustrating an exemplary pump system.

As illustrated in FIG. 2, one or more sensors in the sensor array 200 can be located proximate the pump system 10 for monitoring purposes. The pump system 10 may include a plurality of components. As an example, the pump system 10 may include at least one motor 12 and at least one pump 14. The one or more sensors in the sensor array 200 can be removeably fastened to a component of the pump system 10. As illustrated in FIGS. 2, a first sensor 200 is attached to the motor 12, and a second sensor 200 is attached to the pump 14. It should be appreciated that there can be any number of pump components in the pump system 10 and any number of sensors 200 may be used to monitor the components. Moreover, the sensors 200 can be any suitable type of sensor as described above.

By way of example, a sensor 200 can be fastened by way of bolt, screw, or adhesive material. In other examples, the sensor 200 may comprise a magnetic portion and may be attached to a ferrous metal component of the pump system 10 using the magnetic portion. Alternatively, the sensor 200 may be permanently fixed to a component of the pump system 10 by means of welding, for example. In yet another example, the sensor 200 may be an existing component of the pump system 10. In an embodiment where a sensor 200 is an existing component of the pump system 10, the monitoring system 100 can be configured to communicate with the existing sensor 200 using wired or wireless means according to sound system integration techniques.

The one or more sensors in the sensor array 200 may collect sensor data associated with the one or more components of the pump system 10. The sensor data may be transmitted (e.g., or pulled/polled from the sensor), either wirelessly or via wired connection, and received by the controller 102 for processing. Additionally, or alternatively, the sensor data may be transmitted to the cloud computing network 112 for processing and evaluation. The processing of the data may include detecting or determining a condition of the pump system 10. As discussed above, the condition may be in the form of real time status, a health or maintenance condition, a fault condition, or any other condition of the pump system 10. The monitoring system 100 can trigger a fault condition notification, for example, when a fault condition is detected.

By way of example, a fault condition may be detected by analyzing vibration data from the pump system 10. The vibration data, for instance, may be detected by one or more vibration sensors 200. The controller 102 or a component of the cloud computing network 112 can compare sensor data to pre-determined threshold values to determine the condition of the pump system 10. If a vibration value is outside of the threshold value (E.g., above or below depending on the units and values), an error condition may be triggered. Alternatively, the controller 102 or a component of the remote computing network 112 may analyze the vibration data with one or more algorithms to determine the condition of the pump system.

Figure 3:
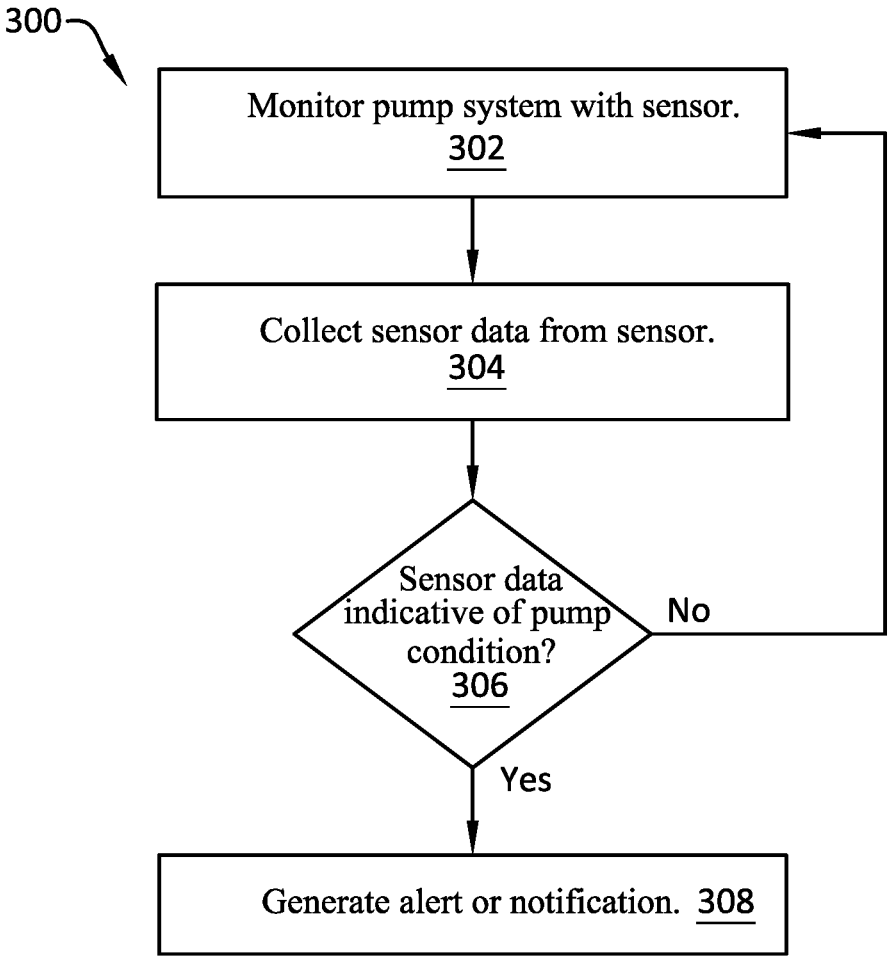
FIG. 3 is an exemplary flow diagram showing an exemplary pump monitoring process.

FIG. 3 illustrates an exemplary monitoring process 300. At step 302, the monitoring system 100 monitoring the pump system 10 using at least one sensor 200. At step 304, the at least one sensor 200 collects sensor data associated with a component of the pump system 10. The sensor data may be transmitted to the controller 102 and/or to the remote computing environment 112. At step 306, the controller 102 and/or a component of the remote computer environment 112 may evaluate the sensor data and determine a pump condition. For instance, a pump condition may be triggered when a value of the sensor data exceeds a threshold value. In another example, a pump condition may be triggered when an algorithm detects a condition using the sensor data. If the sensor data is indicative of a specified pump condition, an alert of notification may be generated at step 308. The alert or notification may be sent to a user via any of the methods as described above. For instance, a pump failure notification may be sent to a user via email (e.g., or other appropriate messaging, such as SMS).

In an embodiment, raw sensor data is analyzed and manipulated into processed or calculated data by the system 100. The raw data sensor data may further be used to generate new forms of data values for use in data calculation or analysis. For instance, a vibration sensor may detect raw vibration data in the form of vibration amplitude and frequency or a time waveform of vibration data. The raw vibration data may be collected and stored in memory, and used by the controller, for example, to generate calculated data such as RPM of a component and RMS (Root Mean Squared) value of the data, etc. It should be appreciated that the data (either raw, manipulated, or generated) may be used as suitable inputs to at least one algorithm, for example.

Figure 4:
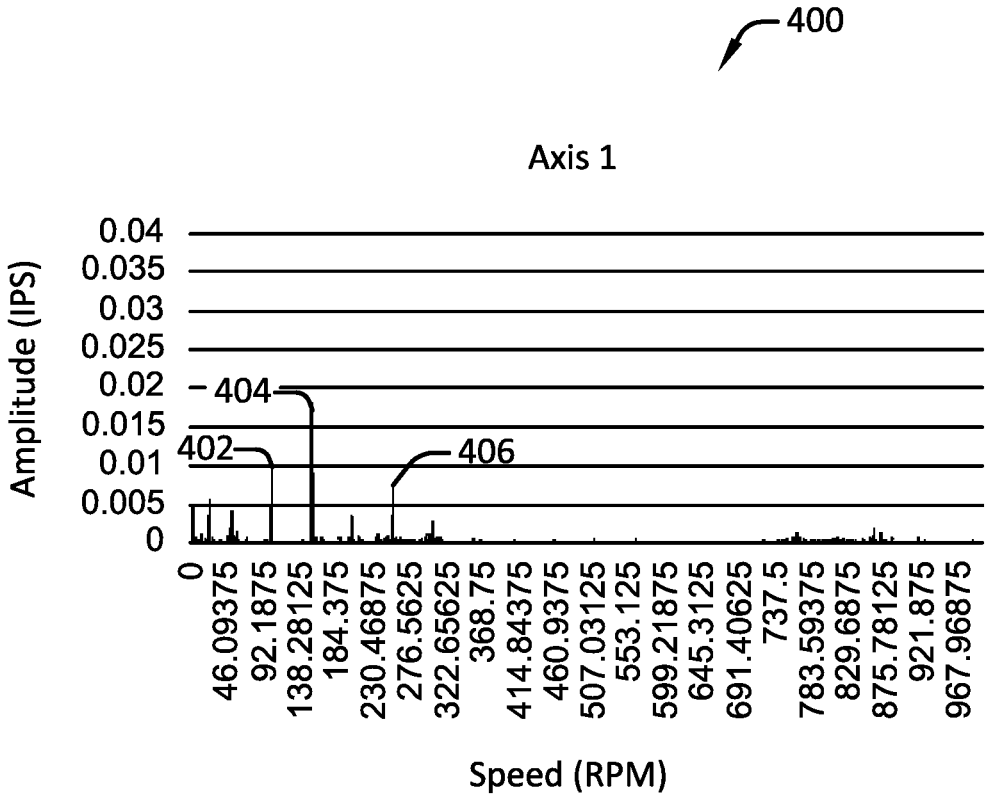
FIG. 4 is an exemplary chart diagram showing speed versus amplitude.
Figure 5:
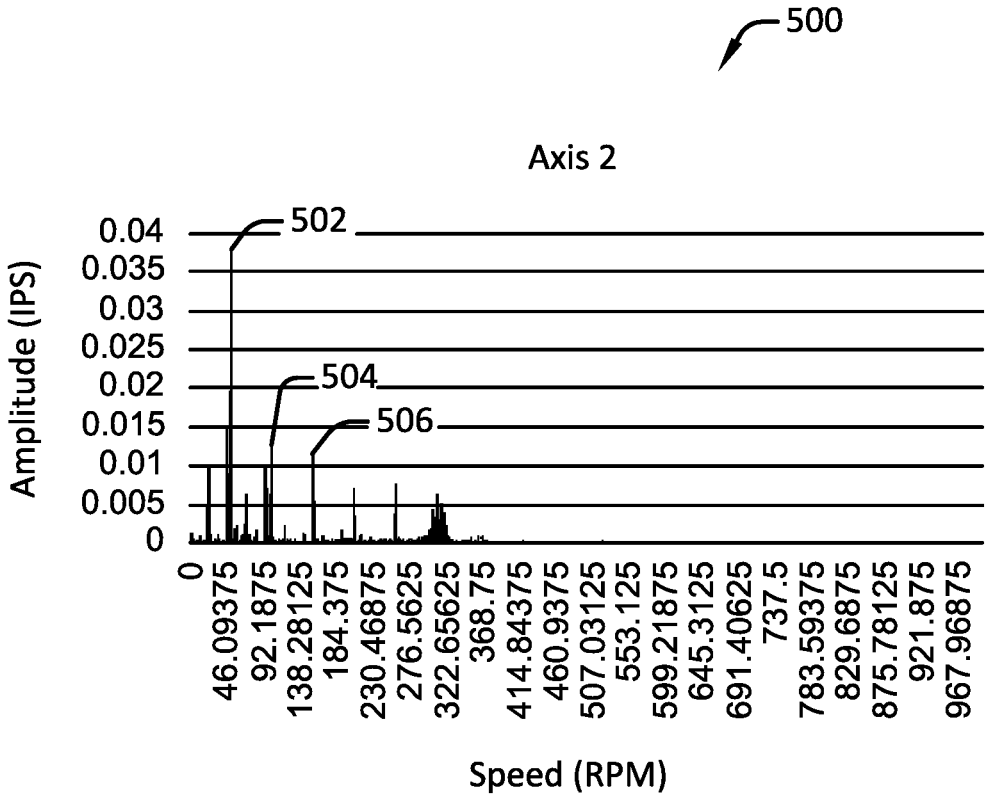
FIG. 5 is another exemplary chart diagram showing speed versus amplitude.
Figure 6:
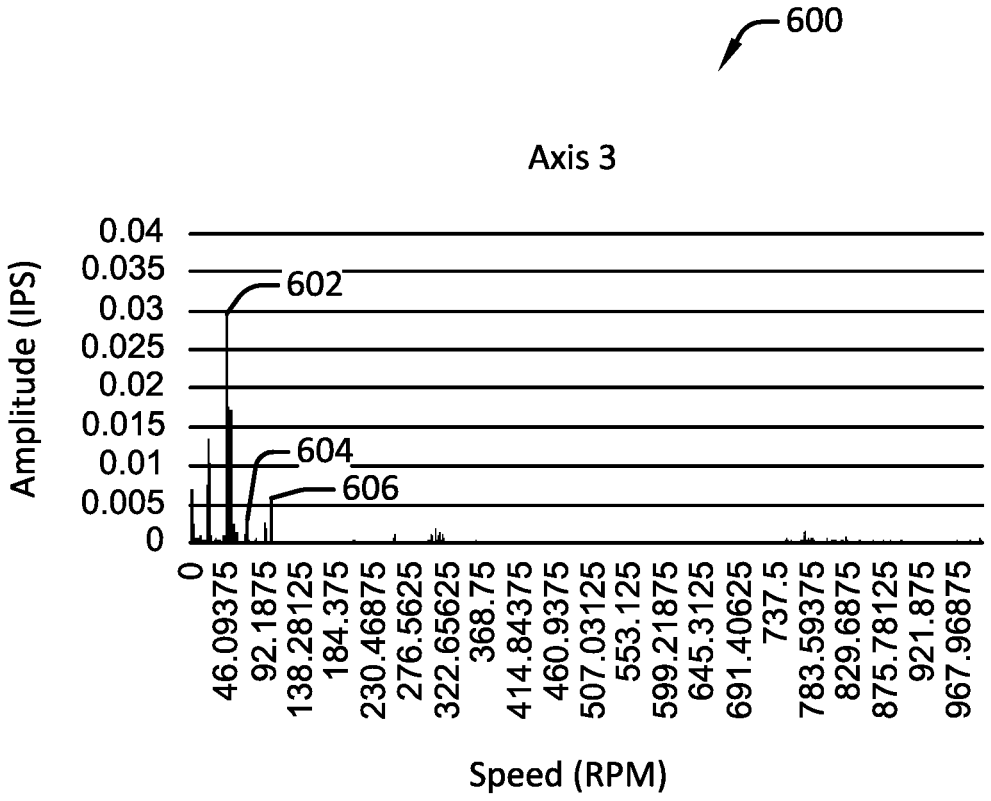
FIG. 6 is another exemplary chart diagram showing speed versus amplitude.

In an embodiment, amplitudes of collected vibration data may be analyzed by the pump monitoring system 100 to detect at least one condition of the pump system 10. The collected vibration data may be plotted along at least one axis. Or, as an example, collected vibration data may be plotted along an X-axis, Y-axis, and a Z-axis. The collected data plotted across each axis can be analyzed and sorted. Data associated with a frequency (Hz) of the pump system 10 may be used to determine pump rotational speed (RPM). The vibration data can also be plotted according to vibration amplitude v. speed (RPM). See for instance, FIGS. 4-6 illustrating exemplary pump data provided in graphical form. FIGS. 4-6 illustrate various spikes in vibration amplitude for various pump RPMs. FIG. 4 may represent data plotted along the X-axis illustrated as graph 400, FIG. 5 may represent data plotted along the Y-axis illustrated as graph 500, and FIG. 6 may represent data plotted along the Z-axis as graph 600.

Each graph 400, 500, and 600 may illustrate a plurality of amplitude spikes that may be indicative of a pump condition. For instance, the graph 400 may indicate a plurality of amplitude spikes such as spike 402, 404, and 406. It should be appreciated that there could be any number of amplitude spikes and the spike labeled on graph 400 are for illustrative purposes. One will appreciate that there are other non-labeled spike on graph 400 as well.

Similarly, the graph 500 may indicate a plurality of amplitude spikes such as spike 502, 504, and 506. It should be appreciated that there could be any number of amplitude spikes and the spike labeled on graph 500 are for illustrative purposes. One will appreciate that there are other non-labeled spike on graph 500 as well. And similarly, the graph 600 may indicate a plurality of amplitude spikes such as spike 602, 604, and 606. It should be appreciated that there could be any number of amplitude spikes and the spike labeled on graph 600 are for illustrative purposes. One will appreciate that there are other non-labeled spike on graph 600 as well.

In an exemplary implementation, a process may be performed for pump data collected by one or more sensors in a sensor array 200. The process may include collecting data detected using one or more sensors 200. A plurality of maximum amplitudes may be recorded by the system (e.g., the top ten highest amplitudes may be recorded). The system may calculate a speed value (RPM) that corresponds with each of the plurality of maximum amplitudes. Each of the speed values may be arranged in an order according to maximum amplitude (e.g., the speed values may be ordered in ascending or descending amplitude values). Each of the plurality of speed values may be divided by a number of teeth on the rotor of the pump 10. The system may then calculate the difference between the speed values. A filtering process may be applied that filters out the differences in speed values that are less than a frequency resolution of the data. The system may then calculate the mode of the filtered speed values. In certain examples, the mode value may be related to or representative of the shaft speed of the pump 10.

In an exemplary implementation, raw vibration data is collected from one or more sensors in a sensor array 200 of the pump monitoring system 100. The data may be in the form of frequency data, and the frequency data may be converted to speed (e.g., cycles per minute (CPM), which can include revolutions per minute (RPM) data. In this manner, a resolution of the frequency data may be calculated. A smaller increment between the frequency and speed data may be indicative of an accuracy value. For instance, a smaller increment between the frequency and speed data may indicate that a more accurate pump shaft speed may be calculated using the collected data.

In an exemplary implementation, the RMS amplitudes may be used when calculating the maximum frequency amplitude spikes. For instance, a frequency amplitude spike may be a multiple of the RMS value for a given set of data.

In an exemplary implementation, the pump monitoring system 100 collects data on the vibration and temperature from the surface of the machinery, autonomously, continuously or at predefined intervals. The pump monitoring system 100 stores the data within the system 100 for collection and analysis if later prompted by a user. Data format consists of raw values (temperature values and vibration "time waveform") and calculated values (vibration Fourier Transform and RMS). If the physical variable values (e.g. temperature or vibration) exceed a threshold value, the device alerts the user by any of a number of means (LED color, email, SMS message, etc.) These threshold values correlate with the machine condition or to undesired process conditions. This data may be sent to a cloud server where they are analyzed and compared against a proprietary series of algorithms to measure machine condition or process condition. This data is then visualized and delivered to the end user via a web application or mobile app, along with notifications, indications of pump/process performance, and potential recommendations for optimization. Units of time of pump operation/inoperation are measured, aggregated, and simplified into a single value for ease of lifecycle quantification. The data is also presented using a visual dashboard, charts and graphs, and individual values indicating overall pump health. Existing pump IOT platforms may lack the capability to perform deductive measurements to identify occurrences (e.g., past and prediction of future) of undesired pump/process conditions such as the pump being over-pressurized, the internal relief valve opening, or the fluid cavitating.

In an exemplary implementation, recorded vibration data may correlate with upset conditions created in a lab environment. The upset conditions may be changes in the amplitude at a given frequency, or the addition of "noise" within a given frequency range. Some upset conditions may be trended via observing an increase in the amount of noise within the given frequency range for that condition. As another example, an upset condition may be indicated by a relative (e.g., predetermined or threshold) change in noise between two (e.g., or more) different frequencies. That is, for example, an upset condition may be indicated when noise increases at a greater rate at a higher (e.g., or first) frequency than a rate of increase of noise at a lower (e.g., or second) frequency. In addition to upset conditions, the overall pump health over its operating life may be calculated with an algorithm that may equate runtime and RMS value, referencing the values given in the standard, ISO 10816-3: "Evaluation of machine vibration by measurements on non-rotating parts," or from values based on data collected from multiple users over time. "Pump health" can be considered to be the RMS value referenced to ISO 10816-3 at that moment (e.g., a snap-shot in time), while an estimate of overall "pump life" may be a function of the aggregate of these (or other) pump health values, over a selected period of time. As one example, this "pump life" value/notification may provide an opportunity (e.g., notification) for the end user identify a maintenance window, such as to schedule repair, order replacement/repair parts, before pump is likely to fail; or may provide an understanding how long they can expect their pump to continue to be used in the existing application. Pump health is a snapshot in time, pump life is aggregation over time.

In another exemplary implementation, the system 100 may allow end users to monitor their equipment lifecycle and schedule planned maintenance of the pump, as well as monitor the happenings of their process. The system 100 may allow end users access to information not otherwise available or comparable to any measurable standard. Additionally, the data may not be interpretable without the specified analytics applied against the collected conditional data. The pump monitoring system 100 describe herein may provide an advantage over end users who either (a) have no comparable data on their pump/process, or (b) have general vibration/temperature data, but no means by which to effectively correlate the data with known issues. This advantage, leading to increased market share, combined with supplying the paid-for service and analysis, may lead to increased revenues for an end user.

In another aspect, as further described herein, autonomously operated systems may not be continuously monitored by people. While scheduled maintenance may occur, the maintenance schedule may not align with actual performance of the systems or anticipate failures. In this aspect, a cloud-based system collects data from such autonomously operated systems, provides visualizations of collected data via a user interface, and analyzes collected data with various models to predict maintenance, determine optimizations, and facilitate troubleshooting of the systems.

In one example, in this aspect, the cloud-based system may be utilized to manage equipment of a system that measures crude oil as it transfers custody from producers to pipeline operators, such as in a lease automatic custody transfer (LACT) unit. In this example, the cloud-based system collects data from a programmable logic controller (PLC) of the LACT unit and provides predictive maintenance, monitoring, troubleshooting, and system optimization. In an aspect, the cloud-based system utilizes and interprets existing PLC data. The cloud-based system enables users to remotely collect and visualize the data to enhance decision making. The cloud-based system further compares actual performance to predicted performance.

According to another example, an acquisition device collects analog inputs, used by the PLC, from various transmitters within the mechanical system. The acquisition device sends collected inputs to the cloud-based system for analysis and comparison against a series of algorithms to measure performance. For instance, the comparison can indicate actual versus predicted performance. The cloud-based system can further generate a visualization of the collected data and/or analysis results and deliver the visualization to a user via a web-based application or other client application. In addition to the visualization, the cloud-based system can deliver notifications, potential recommendations for optimization, and indications of component (e.g. pump) performance.

A data logger device can transmit the data to the cloud-based system via a variety of paths. For instance, the data logger can utilize file transfer protocol (FTP) or email. Alternatively, the data logger may be a wireless gateway device such as an IQRF gateway device or IQUBE, which connects a wireless mesh network to the cloud-based system (e.g., Wi-SUN—an interoperable, multi-service and secure wireless mesh network that can be used for large-scale outdoor IoT wireless communication networks). These types of networks can allow for a signal from a first module to be re-routed around obstacles (e.g., walls, metal objects, etc.) to a second module; and can allow for the sending of full, large data packets (e.g., fast Fourier transforms (FFTs)) over the network. As an example, a battery powered (e.g., or locally powered by electrical energy powering pump, or by mesh network) network component (e.g., networking chip) can be disposed on or proximate the sensor(s). The networking component can be used to communicate data to other modules in the network, and/or to a cloud computing system.

According to various examples, the data may be formatted and/or extracted before subsequently processed with one or more mathematical models. For example, units of time of pump operation/inoperation are measured, aggregated, and simplified into a single value for ease of lifecycle quantification. Collected data may also be presented via a visual dashboard. For instance, the cloud-based system can generate charts and graphs and/or present individual values or happenings within the system as totalized quantities.

The cloud-based system presents real-time collected data as compared to theoretical expected performance in order quantify pump and pipeline hydraulics. In addition, the cloud-based system utilizes the models to generate deductive measurements to predict items such as liquid viscosity, vapor pressure, volume or any other unmeasured element of the crude oil properties.

The cloud-based system disclosed herein enables users to monitor lifecycle and schedule rebuild of a LACT pump, as well as monitor others occurrences within the LACT unit. The cloud-based system provides users with access to information not otherwise available or comparable to any measurable standard. Additionally, the data is difficult to interpret without predictive analytics applied against the collected data. For instance, high precision of an involute gear profile is possible. The pump monitoring and analytics solution described herein can be applied to other area such as chemical plants and food manufacturing.

Figure 7:
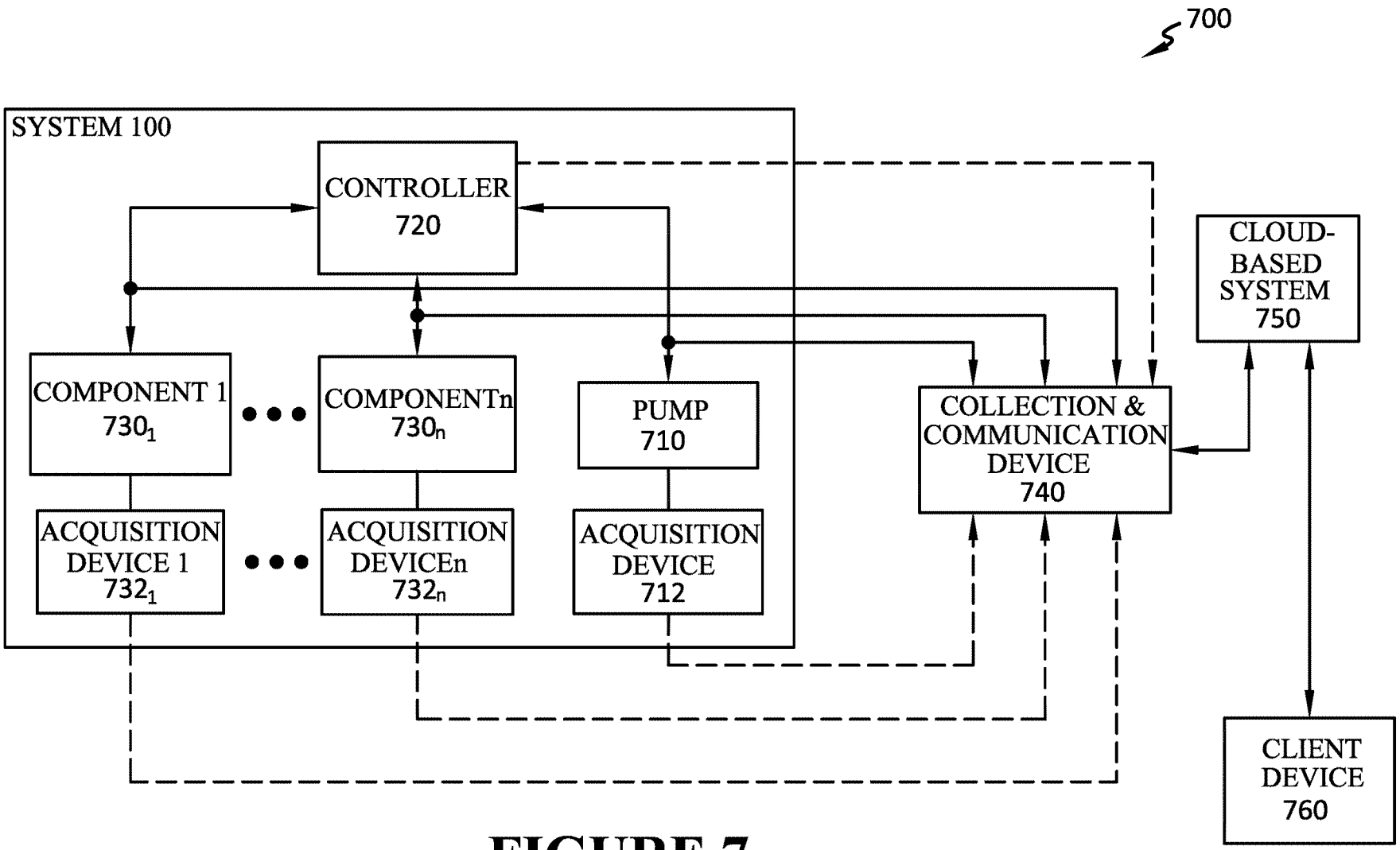
FIG. 7 illustrates an exemplary, embodiment of a monitoring system in accordance with various aspects.

Referring now to FIG. 7, which is a schematic block diagram of an exemplary, non-limiting embodiment of a monitoring system 700. System 700 can include a monitored system 700, which includes a controller 720, components 730 (e.g. numbered 1 to n, where n is an integer greater than or equal to 1), and a pump 710. In some examples, system 700 may be a LACT unit.

In accordance with an example, system 700 includes a collection & communication (C&C) device 740 configured data from system 700. C&C device 740 may collect inputs to controller 720 transmitted from components 730 and pump 710. In another example, system 700 includes acquisition devices 732 associated with components 730 and an acquisition device 712 associated with pump 710. Acquisition device 712, 732 may be sensor configured to measure and/or acquire parameters of components 730 and/or pump 710, and transmit associated data to the C&C device 740. In yet another example, the C&C device 740 may directly receive relevant data from controller 720. As an example, the location of the sensor(s) can be proximate the pumped fluid, such as near the pumping chamber, at a front of the pump. Current system typically place a sensor near the shaft bearings in order to detect vibrations or temperature from the bearings, which could indicate wear or damage. In some implementations, in this innovation, placing the sensor(s) proximate the location of the fluid pumping (e.g., pump head) may allow for detection of fluid process failure, or at least indicative of conditions that may lead to pump failure, maintenance, other target conditions. That is, for example, detecting fluid vibration can allow for detection of fluid faults, unlike current version which detect limited types of machine faults (e.g., bearing failure).

In one aspect, several types of failure modes may be identified by the example systems and methods described herein. These various modes may be indicated by detection of different vibrations over a period of time, which can be compared with known conditions. For example, a cavitation (e.g., of fluid) can be identified, which may be a result of high vapor pressure, having a suction line that is too long for the process, having a pumped fluid with high viscosity, having an upstream blockage, and/or having a suction valve closure. These conditions may be detected by indication of cavitation. Further, for example, a dry-run mode may be indicated, such as where the pump is not properly primed, the source tank is empty, and/or where there is air binding. Additionally, a relief valve overpressure mode can be indicated, such as when there is a valve closure, a downstream blockage, or a relief valve set incorrectly. Future states may also be indicated or predicted. An overspeeding mode can be indicted where the suction pressure exceeds discharge; unexpected pump stoppage can be indicated where the motor stops, a reducer or pump is locked up' a misalignment mode can be indicted where the shaft is misaligned, bushings are worn, or gear teeth are worn; and an over temperature mode can be indicated where there is slip of grater than fifty percent of flow, there is viscous shear, or where packing is gripping the shaft.

As shown in FIG. 7, C&C device 740 sends collected data to a cloud-based system 750. The cloud-based system 750, as described above, can analyze collected data with various predictive models to predict maintenance or failure, determine potential optimizations, and/or compare performance to a predicted performance. The cloud-based system 750 is further communicatively coupled to client device 760 to provide visualizations of collected data, analysis results, predictions, warnings, notifications, and other information.

Figure 8:
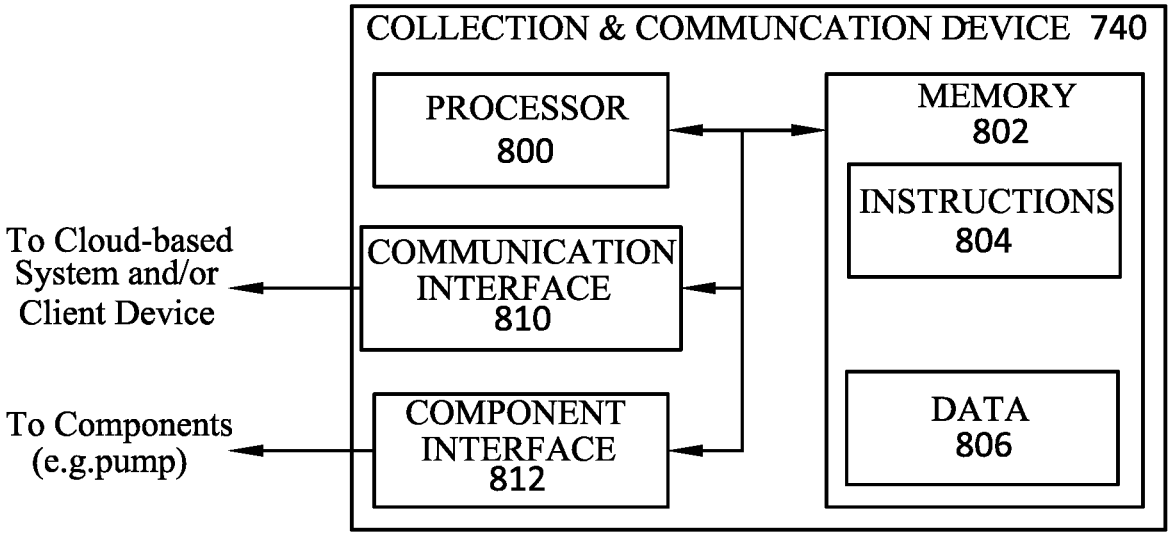
FIG. 8 illustrates an exemplary, embodiment of a collection & communication (C&C) device according to one or more aspects.

Turning to FIG. 8, illustrated is a schematic block diagram of an exemplary, non-limiting embodiment for a collection & communication (C&C) device 740. As shown in FIG. 8, C&C device 740 includes one or more processor(s) 800 configured to execute computer-executable instructions 804 such as instructions composing a data collection and communication process. Such computer-executable instructions can be stored on one or more computer-readable media including non-transitory, computer-readable storage media such as memory 802. For instance, memory 802 can include non-volatile storage to persistently store instructions 804 and/or data 806. Memory 802 can also include volatile storage that stores instructions 804, other data (working data or variables), or portions thereof during execution by processor 800.

C&C device 740 includes a communication interface 810 to couple C&C device 740, via the Internet or other communications network, to various remote systems such as, but not limited to, cloud-based system 750, client device 760, other controllers, or Internet-enabled devices (e.g., IoT sensors). Communication interface 810 can be a wired or wireless interface including, but not limited to, a Wi-Fi interface, an Ethernet interface, a Bluetooth interface, a fiber optic interface, a cellular radio interface, a satellite interface, etc. The communications interface 810 can be configured to communicate with client devices and/or cloud-based systems through a local area network co-located with system 700.

A component interface 812 is also provided to couple C&C device 740 to various components of system 700. For instance, component interface 812 can connect C&C device 740 to components 730, pump 710, controller 720, acquisition devices 732, acquisition device 712, etc. Via the component interface 812, the C&C device 740 can collect data from system 700, which is subsequently transmitted to cloud-based system 750 via the communications interface 810. The component interface 812 can implement various wired or wireless interfaces such as, but not limited to, a USB interface, a serial interface, a Wi-Fi interface, a short-range RF interface (Bluetooth), an infrared interface, a near-field communication (NFC) interface, etc.

Figure 9:
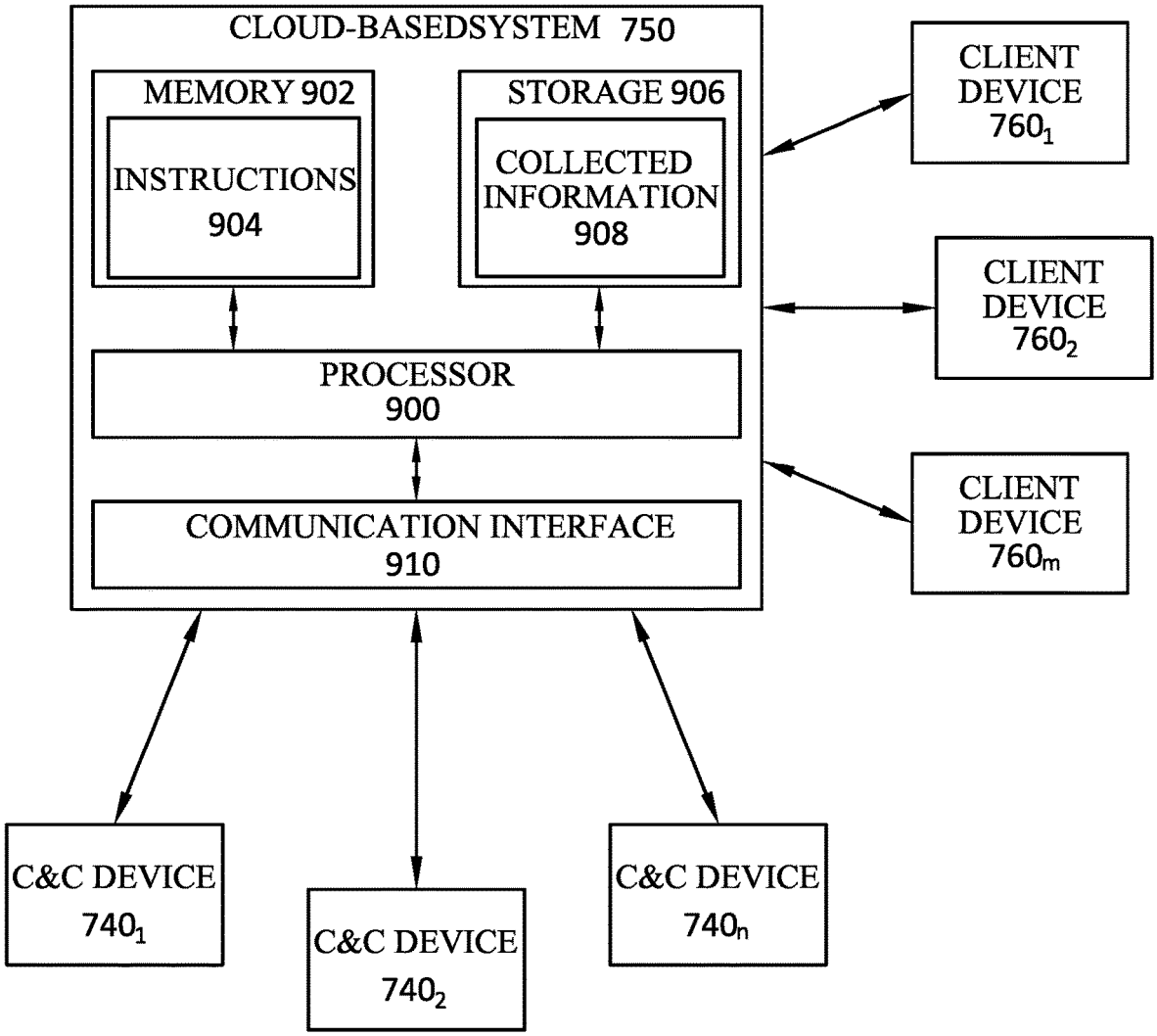
FIG. 9 illustrates an exemplary, embodiment of a cloud-based system in accordance with various aspects.

Referring to FIG. 9, an exemplary, non-limiting embodiment of a cloud-base system 750 is illustrated. As shown in FIG. 9, cloud-based system 750 includes one or more processor(s) 900 configured to execute computer-executable instructions 904 such as instructions composing a monitoring process to format and analyze collected data from monitored systems with various models. Such computer-executable instructions can be stored on one or more computer-readable media including non-transitory, computer-readable storage media such as memory 902 or storage 906. For instance, storage 906 can include non-volatile storage to persistently store instructions 904 and/or collected information 908 received from C&C device 740. Memory 902 can also include volatile storage that stores instructions 904, other data (working data or variables), or portions thereof during execution by processor 900. The collected information 908 can be stored in association with users and/or serial numbers or other identifiers of system 700 or pump 710.

Cloud-based system 750 further includes a communication interface 910 to couple cloud-based system 750, via the Internet or other communications network, to C&C device 740 and client devices 760. Communication interface 910 can be a wired or wireless interface including, but not limited to, a Wi-Fi interface, an Ethernet interface, a Bluetooth interface, a fiber optic interface, a cellular radio interface, a satellite interface, etc. As shown in FIG. 9, cloud-based system 750 can service a plurality of C&C device 740, which include C&C device $\mathbf{740}_1$, C&C device $\mathbf{740}_2$, . . . , C&C device $\mathbf{740}_n$, where n is an integer greater than or equal to one. The C&C device 740 can be associated with different monitored systems. Similarly, a plurality of client devices $\mathbf{760}_1$, $\mathbf{760}_2$, . . . , $\mathbf{760}_m$ (where m is an integer greater than or equal to one) can communicate with cloud-based system 750.

Figure 10:
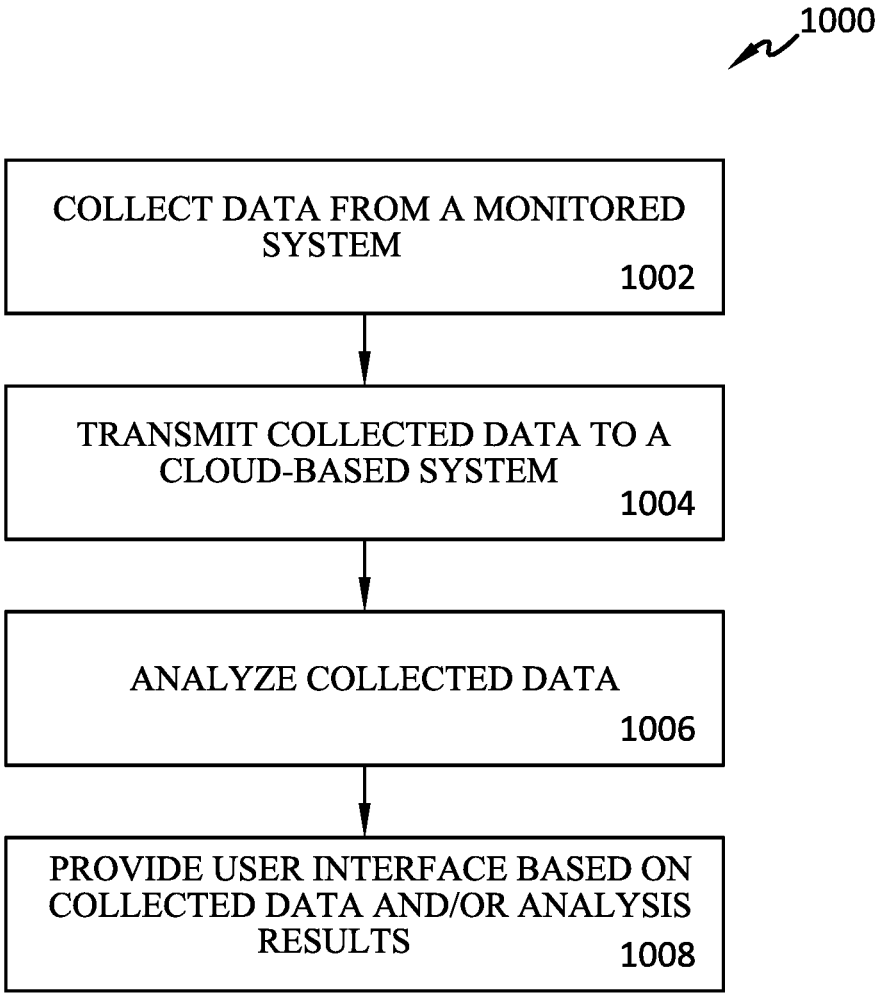
FIG. 10 illustrates an exemplary, embodiment of a method for monitoring a system.

Turning to FIG. 10, an exemplary, non-limiting embodiment of a monitoring method is depicted. Method 1000 can be implemented, for example, by system 700 described above in connection with FIG. 7. Method 1000 can begin at reference numeral 1002 where data is collected from a monitored system. At 1004, the collected data is transmitted to a cloud-based system. The data may be collected and transmitted by a collection & communication device described above. At 1006, the cloud-based system analyzes collected data and, at 1008, provides a user interface to client devices. The user interface is based on and/or provides visualizations of the collected data and/or analysis results.

Figure 11:
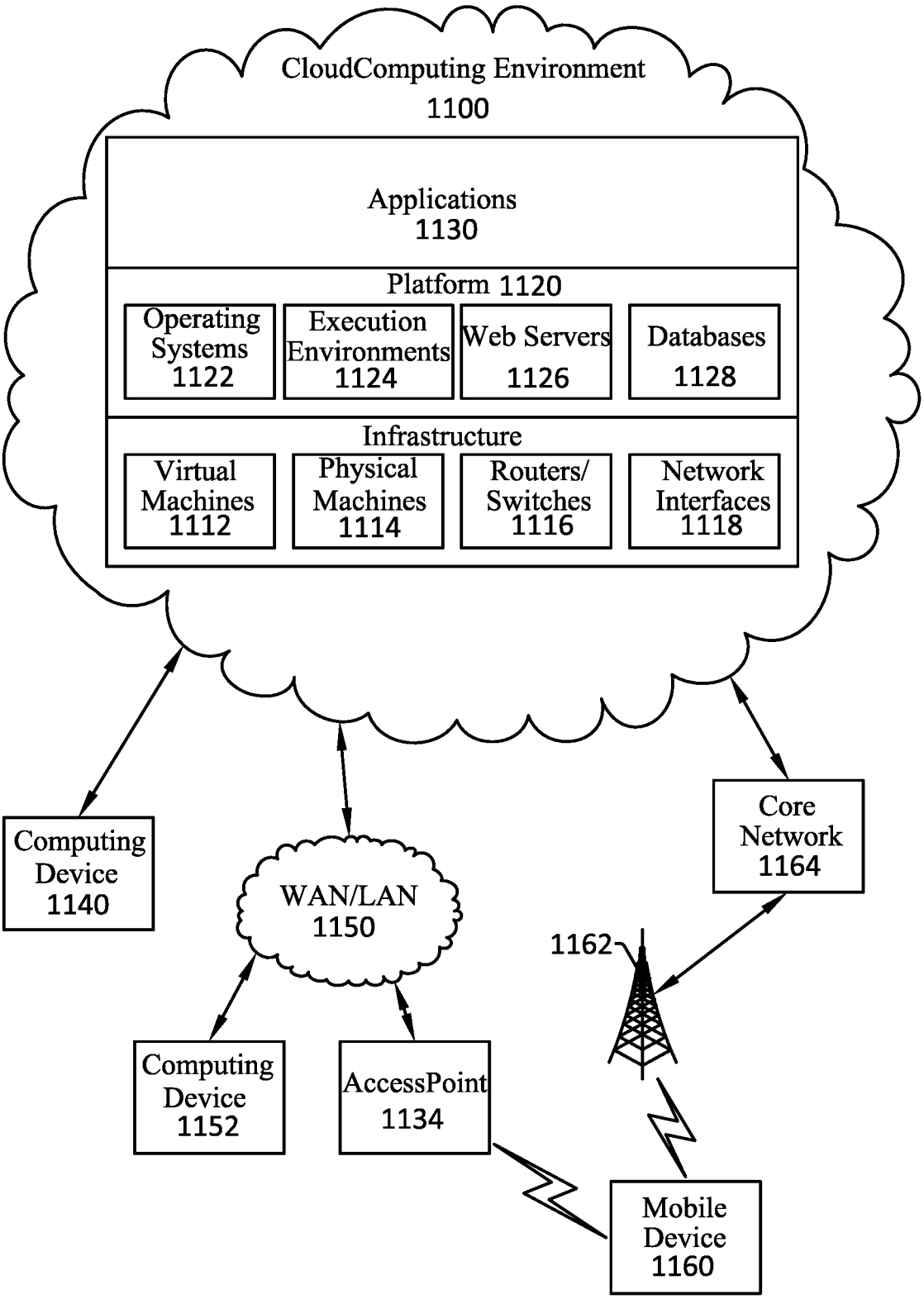
FIG. 11 is a schematic diagram representing an exemplary, networked environment, including cloud or internet based, in which various embodiments described herein can be implemented.

FIG. 11 provides a schematic diagram of an exemplary networked or distributed computing environment, such as a cloud computing environment 1100. The cloud computing environment 1100 represents a collection of computing resources available, typically via the Internet, to one or more client devices. The cloud computing environment 1100 comprises various levels of abstraction: infrastructure 1110, a platform 1120, and applications 1130. Each level, from infrastructure 1110 to applications 1130 is generally implemented on top of lower levels, with infrastructure 1110 representing the lowest level.

Infrastructure 1110 generally encompasses the physical resources and components on which cloud services are deployed. For instance, infrastructure 1110 can include virtual machines 1112, physical machines 1114, routers/switches 1116, and network interfaces 1118. The network interfaces 1118 provide access to the cloud computing environment 1100, via the Internet or other network, from client devices such as computing devices 1140, 1152, 1160, etc. That is, network interfaces 1118 provide an outermost boundary of cloud computing environment 1100 and couple the cloud computing environment 1100 to other networks, the Internet, and client computing devices. Routers/switches 1116 couple the network interfaces 1118 to physical machines 1114, which are computing devices comprising computer processors, memory, mass storage devices, etc. Hardware of physical machines 1114 can be virtualized to provide virtual machines 1112. In an aspect, virtual machines 1112 can be executed on one or more physical machines 1114. That is, one physical machine 1114 can include a plurality of virtual machines 1112.

Implemented on infrastructure 1110, platform 1120 includes software that forms a foundation for applications 1130. The software forming platform 1120 includes operating systems 1122, programming or execution environments 1124, web servers 1126, and databases 1128. The software of platform 1120 can be installed on virtual machines 1112 and/or physical machines 1114.

Applications 1130 include user-facing software applications, implemented on platform 1120, that provide services to various client devices. In this regard, the cloud-based system 750 of the monitoring system 700 described herein is an example application 1130. As illustrated in FIG. 11, client devices can include computing devices 1140, 1152 and mobile device 1160. Computing devices 1140, 1152 can be directly coupled to the Internet, and therefore the cloud computing environment 1100, or indirectly coupled to the Internet via a WAN/LAN 1150. The WAN/LAN 1150 can include an access point 1154 that enables wireless communications (e.g., Wi-Fi) with mobile device 1160. In this regard, via access point 1154 and WAN/LAN 1150, mobile device 1160 can communicate wirelessly with the cloud computing environment 1100. Mobile device 1160 can also wirelessly communicate according to cellular technology such as, but not limited to, GSM, LTE, WiMAX, HSPA, etc. Accordingly, mobile device 1160 can wirelessly communicate with a base station 1162, which is coupled to a core network 1164 of a wireless communication provider. The core network 1164 includes a gateway to the Internet and, via the Internet, provides a communication path to the cloud computing environment 1100.

As an illustrative example, the detection of fluid vibrations over a selected period of time can be indicative of overall pump health. That is, for example, over the selected period of time, the innovative system can detect periods when the pump was in myriad severity levels. For example, pre-determined severity levels (e.g., of vibration) can be identified, such as a pump potential damage level (e.g., level 4), short-term operation allowable (e.g., level 3), unlimited long-term operation allowable (e.g., level 2), and new machine condition level (e.g., level 1). In this example, these levels are indicated by the amount, type, and term of vibration detected. During the pre-determined period of time, the target pump may move between these levels depending on use, type of pumped fluid, maintenance, conditions, etc. During the pre-selected period of time, the overall pump life can be indicated by an amount of time the pump spends in each level, and the level itself. The pump health can then be used to determine the expected life of the pump, and ongoing maintenance needed.

As mentioned above, while exemplary embodiments have been described in connection with various computing devices and network architectures, the underlying concepts may be applied to any network system and any computing device or system in which it is desirable to implement an image segmentation system.

Also, there are multiple ways to implement the same or similar functionality, e.g., an appropriate API, tool kit, driver code, operating system, control, standalone or downloadable software objects, etc. which enables applications and services to take advantage of the techniques provided herein. Thus, embodiments herein are contemplated from the standpoint of an API (or other software object), as well as from a software or hardware object that implements one or more embodiments as described herein. Thus, various embodiments described herein can have aspects that are wholly in hardware, partly in hardware and partly in software, as well as in software.

Moreover, the word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A method for monitoring a pump system, comprising:

monitoring, via at least one vibration sensor, at least one characteristic of fluid flow throughout the pump system with the at least one vibration sensor, wherein the at least one vibration sensor is located proximate a component of the pump system to detect fluid vibration of the fluid flow;

transmitting, by the at least one vibration sensor, sensor data associated with the at least one monitored characteristic of the fluid flow to a remote computer in communication with the at least one vibration sensor, wherein the sensor data is accessible to a user from a user device in communication with the remote computer;

determining, by at least one processor of the remote computer, a fault condition relating to the at least one monitored characteristic of the fluid flow, the fault condition triggered when the sensor data is indicative of a condition that exceeds a threshold value, wherein the at least one processor uses amplitudes of the sensor data associated with the at least one monitored characteristic of the fluid flow and rotational speed data of the pump system to determine the fault condition, wherein when determining the fault condition, the at least one processor is configured to use the amplitudes of the sensor data and the rotational speed data of the pump system at least by sorting rotational speed values in the rotational speed data in an ascending or descending order according to the maximum amplitude associated with each rotational speed value, and wherein the threshold value is configured to correlate with the at least one monitored characteristic of the fluid flow;

transmitting, by the at least one processor of the remote computer, a health detection notification signal when the fault condition is triggered; and issuing, by the user device, a warning based on the received health detection notification signal to notify the user, the warning comprising at least one or more of: an email, an SMS message, a cloud-based message, an alarm sound, and/or a light signal.

2. The method of claim 1, wherein the at least one vibration sensor is disposed proximate a pump head of the pump system to detect fluid vibration.

3. The method of claim 1, wherein a communications component is coupled with the at least one vibration sensor to receive the sensor data, and the communications component is communicatively coupled with a mesh network to transmit the sensor data remotely to the remote computer.

4. The method of claim 1, wherein the method further comprises determining, by the remote computer, an optimization signal based on the health detection notification signal when the fault condition is triggered; transmitting, by the remote computer, the optimization signal to the user device; and issuing, by the user device, a recommendation based on the optimization signal onto the user device to guide the user with resolving the fault condition in the fluid flow.

5. The method of claim 1, wherein the fault condition is triggered when the sensor is indicative of the condition that exceeds the threshold value for a predetermined time period.

6. The method of claim 1, wherein the at least one processor bases the fault condition at least on magnitudes of the amplitudes of the sensor data when the amplitudes of the sensor data are plotted against the rotational speed data of the pump system.

7. The method of claim 1, wherein the at least one processor is configured to divide each rotational speed value by the number of teeth on a gear of the pump when determining the fault condition.

8. The method of claim 1, wherein the at least one processor is configured to determine differences in values of the rotational speed and filter out the differences in values of the rotational speed based on a frequency resolution of the rotational speed data when determining the fault condition.

9. The method of claim 1, wherein the at least one processor further uses the number of teeth on a gear of the pump system to determine the fault condition.

10. A monitoring system for a pumping unit, comprising:

a collection and communication device disposed in the pumping unit and having one or more processors configured to execute computer-executable instructions that, when executed by the one or more processors, cause the collection and communication device to acquire data from the pumping unit and transmit acquired data to a remote computing system, the collection and communication device comprising:

a vibration sensor proximate a component of the pumping unit configured to detect vibrations within fluid flowing through the pumping unit and provide vibration data corresponding to a characteristic of the fluid flow through the pumping unit; and a communication component configured to transmit the vibration data to the remote computing system; and a client device communicatively coupled to the remote computing system, wherein the remote computing system has one or more processors configured to execute computer-executable instructions that, when executed by the one or more processors, cause the remote computing system to receive the acquired data, analyze the acquired data with one or more predetermined models, and transmit a health detection notification signal to the client device when the analysis of the acquired data by the remote computing system is indicative of a fault condition in the fluid flow, wherein the analysis of the acquired data utilizes amplitudes of the vibration data and rotational speed data of the pumping unit at least by sorting rotational speed values in the rotational speed data in an ascending or descending order according to the maximum amplitude associated with each rotational speed value, and wherein the client device is configured to receive the health detection notification signal and issue a warning of the fault condition in the fluid flow based on the health detection notification signal.

11. The system of claim 10, wherein the remote computing system is configured to determine an actual performance of the pumping unit based on the acquired data and compare the actual performance to a predetermined predicted performance based on the one or more predetermined models.

12. The system of claim 10, wherein the acquired data is also indicative of a predicted pump life of the pumping unit.

13. The system of claim 10, wherein the fault condition is indicative of a current fault or a predicted future fault for the pumping unit.

14. The system of claim 10, wherein the computer-executable instructions of the remote computing system, when executed by the one or more processors, cause the remote computing system to transmit an optimization signal to the client device based on the analysis of the health detection notification signal, wherein the client device is further configured to receive the optimization signal and issue a recommendation for resolving the fault condition in the fluid flow by a user of the pumping unit based on the optimization signal.

15. The system of claim 14, wherein the fault condition is dry-run, and wherein the recommendation is at least one of: prime the pumping unit, replenish source tank, and/or remove air.

16. A system for detecting a condition of a pump unit, the system comprising:

a pump comprising a rotating shaft engaged with a rotating pump head to pump a target fluid;

a vibration sensor disposed proximate a component of the pump unit to detect fluid vibration of the target fluid and produce vibration data;

a communication component communicatively coupled with the vibration sensor to transmit the vibration data; and a remote computing device disposed remotely from the pump, communicatively coupled to the communication component, and configured to receive the vibration data from the communication component, wherein the remote computing device comprises a processor for processing data and instructions, and memory comprising instructions, wherein the instructions, when executed by the processor, cause the remote computing device to determine a health condition of the pump unit based at least on amplitudes of the vibration data and rotational speed data of the component of the pump unit and provide the health condition of the pump unit to an end user device remotely coupled with the remote computing device, the end user device configured to issue a warning based on the provided health condition, wherein the health condition of the pump unit is indicative of a fault condition in the target fluid flowing through the pump, and wherein to determine the health condition, the instructions, when executed by the processor, at least cause the remote computing device to at least sort rotational speed values in the rotational speed data in an ascending or descending order according to the maximum amplitude associated with each rotational speed value.

17. The system of claim 16, wherein the wherein the instructions of the remote computing device, when executed by the processor, further cause the remote computing device to determine an optimization signal and provide the optimization signal to the end user device, wherein the optimization signal corresponds to the health condition of the pump and is indicative of a recommendation for resolving the fault condition in the target fluid flowing through the pump.

18. The system of claim 17, wherein the fault condition is cavitation, and wherein the recommendation is at least one of: reduce vapor pressure, reduce the length of a suction line the pump, reduce the viscosity of the target fluid, remove upstream blockage, and/or open suction valve.

19. The system of claim 17, wherein the fault condition is dry-run, and wherein the recommendation is at least one of: prime the pump, replenish source tank, and/or remove air.

20. The system of claim 17, wherein the fault condition is an overpressure in a relief valve, and wherein the recommendation is at least one of: open a valve, remove downstream blockage, and/or reset the relief valve.

* * * * *